US009335672B2

(12) United States Patent
Kamijo et al.

(10) Patent No.: US 9,335,672 B2
(45) Date of Patent: May 10, 2016

(54) TUBULAR MEMBER, TUBULAR MEMBER UNIT, INTERMEDIATE TRANSFER MEMBER, AND IMAGE FORMING APPARATUS

(71) Applicant: FUJI XEROX CO., LTD., Tokyo (JP)

(72) Inventors: Yukiko Kamijo, Kanagawa (JP); Kenji Omori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/614,937

(22) Filed: Feb. 5, 2015

(65) Prior Publication Data

US 2016/0085184 A1 Mar. 24, 2016

(30) Foreign Application Priority Data

Sep. 24, 2014 (JP) ..... 2014-193530

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS

| | | | | |
|---|---|---|---|---|
| 2001/0026709 | A1 * | 10/2001 | Hara et al. | 399/174 |
| 2002/0160200 | A1 | 10/2002 | Kaga | |
| 2003/0159773 | A1 * | 8/2003 | Tomiyama et al. | 156/248 |
| 2006/0172097 | A1 * | 8/2006 | Morikoshi et al. | 428/35.7 |
| 2009/0016787 | A1 | 1/2009 | Kurachi | |
| 2009/0074478 | A1 | 3/2009 | Kurachi | |

FOREIGN PATENT DOCUMENTS

| | | | |
|---|---|---|---|
| JP | 2002-328541 | A | 11/2002 |
| JP | 2003005538 | A * | 1/2003 |
| JP | 2009-001609 | A | 1/2009 |
| JP | 2009-020154 | A | 1/2009 |
| JP | 2010-139560 | A | 6/2010 |

OTHER PUBLICATIONS

English Translation JP 2003005538 A, Morikoshi et al., Jan. 2003.*

* cited by examiner

*Primary Examiner* — Ryan Walsh
(74) *Attorney, Agent, or Firm* — Oliff PLC

(57) ABSTRACT

A tubular member includes a resin layer containing a thermoplastic resin and a conductive material, and the resin layer forming a sea part in which the thermoplastic resin becomes a matrix phase, wherein an area ratio of the sea part to a portion in a range of 5 μm respectively to a front surface portion side and a rear surface portion side with a central portion of the resin layer in a thickness direction as a center is greater by 3% to 15% than a greater area ratio between an area ratio of the sea part to a portion in a range of 10 μm from a front surface portion of the resin layer in the thickness direction and an area ratio of the sea part to a portion in a range of 10 μm from a rear surface portion in the thickness direction.

20 Claims, 2 Drawing Sheets

TUBULAR MEMBER, TUBULAR MEMBER UNIT, INTERMEDIATE TRANSFER MEMBER, AND IMAGE FORMING APPARATUS

CROSS-REFERENCE TO RELATED APPLICATIONS

This application is based on and claims priority under 35 USC 119 from Japanese Patent Application No. 2014-193530 filed Sep. 24, 2014.

BACKGROUND

Technical Field

The present invention relates to a tubular member, a tubular member unit, an intermediate transfer member, and an image forming apparatus.

SUMMARY

According to an aspect of the invention, there is provided a tubular member including:

a resin layer containing a thermoplastic resin and a conductive material, and the resin layer forming a sea part in which the thermoplastic resin becomes a matrix phase, wherein an area ratio of the sea part to a portion in a range of 5 μm respectively to a front surface portion side and a rear surface portion side with a central portion of the resin layer in a thickness direction as a center is greater by 3% to 15% than a greater area ratio between an area ratio of the sea part to a portion in a range of 10 μm from a front surface portion of the resin layer in the thickness direction and an area ratio of the sea part to a portion in a range of 10 μm from a rear surface portion in the thickness direction.

BRIEF DESCRIPTION OF THE DRAWINGS

Exemplary embodiments of the present invention will be described in detail based on the following figures, wherein.

DETAILED DESCRIPTION

Hereinafter, exemplary embodiments are described in detail with reference to the drawings.

Tubular Member

Figure 1:
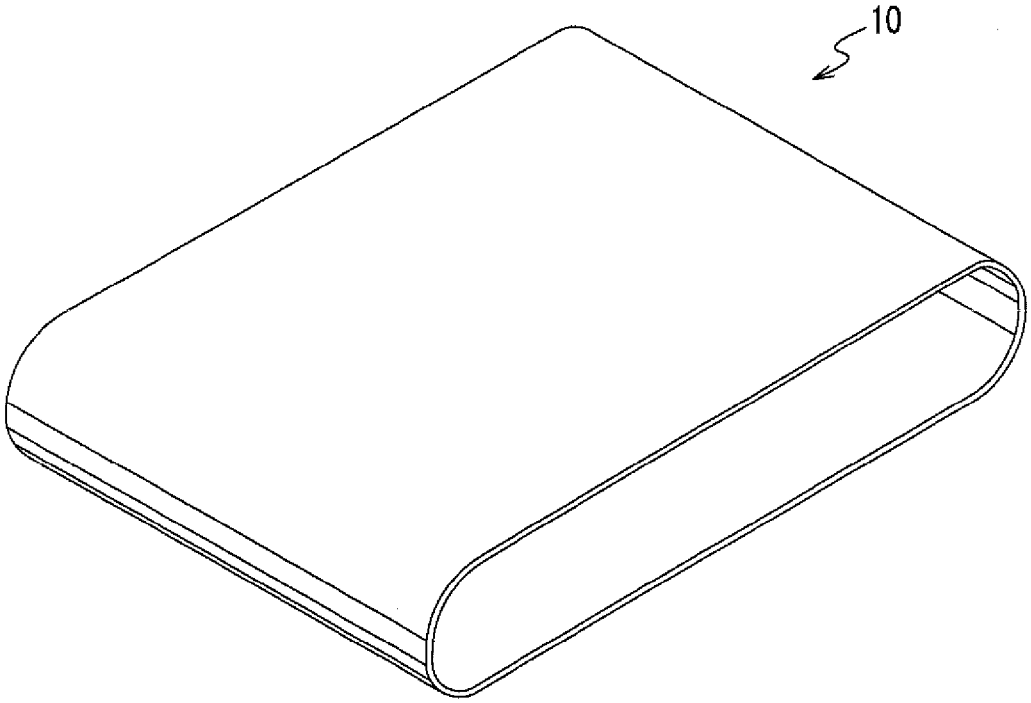
FIG. 1 is a perspective view schematically illustrating a tubular member according to an exemplary embodiment.

FIG. 1 is a perspective view schematically illustrating a tubular member according to the exemplary embodiment.

As illustrated in FIG. 1, a tubular member 10 (hereinafter, referred to as an "endless belt") according to the embodiment is formed to be an endless shape, and is configured to have a resin layer (hereinafter, referred to as a "specific resin layer") containing a thermoplastic resin and a conductive material. Further, FIG. 1 illustrates an example in which the endless belt is configured with a single layer member of a specific resin layer. Also, an area ratio of the sea part to a portion in a range of 5 μm respectively to a front surface portion side and the rear surface portion side with the central portion of the resin layer in the thickness direction as a center is greater by 3% to 15% (hereinafter, referred to as a "specific structure") than a greater value of the area ratios of the sea parts to portions in a thickness range of 10 μm respectively from the front surface portion and the rear surface portion of the resin layer.

Here, the "sea part" refers to a phase of the thermoplastic resin that becomes a matrix phase of the endless belt. In addition, the "front surface portion" and the "rear surface portion" respectively refer to the outermost surface and the innermost surface of the endless belt.

In addition, in the specific structure, the area ratio of the sea part to a portion in the range of 5 μm respectively to the front surface portion side and the rear surface portion side with the central portion in the thickness direction of the resin layer as a center is greater preferably by 4.0% to 10% and more preferably by 5.0% to 6.5% than a greater value of the area ratios of the sea parts to portions in a thickness range of 10 μm respectively from the front surface portion and the rear surface portion of the resin layer.

In the related art, a tubular member configured with a resin layer obtained by dispersing a conductive material such as carbon black in a thermoplastic resin has been known. However, in the tubular member of this configuration, an area (fine white spot) in which a toner image is deleted in an output image may be formed. It is considered that the phenomenon in which the fine white spot is formed is caused by electrons that inflow from a member contacting the rear surface side of the tubular member such as a transfer unit to the tubular member. More specifically, if electrons that inflow to the tubular member flow through the inside portion of the tubular member to reach the front surface portion, the positive charges and the electrons pair-annihilate in the front surface portion of the tubular member so that a current path from the rear surface portion to the front surface portion of the tubular member is formed, the electric resistance decreases, and thus the discharge current increases. It is considered that the fine white spot is formed by the increase of the discharge current. In addition, the fine white spot caused by the increase of the discharge current tends to be more conspicuous as the applied voltage increases for reasons such as high processing speed.

In order to prevent the formation of the fine white spot, the dispersibility of the conductive material in the front surface portion or the rear surface portion may be enhanced. Currently, there are various methods of manufacturing a specific resin layer, but a certain amount of conductive material is needed in order to simply enhance the dispersibility of the conductive material. Then, since the overall volume resistivity of the specific resin layer decreases, the current path from the rear surface portion to the front surface portion of the tubular member may be easily formed, and since the electric resistance easily decreases, the discharge current easily increases so that the fine white spot is formed again.

On the contrary, the specific resin layer containing the thermoplastic resin and the conductive material is applied to the endless belt according to the exemplary embodiment to form the specific structure, and the stability of the electric resistance becomes excellent. As a result, the formation of the fine white spot is prevented.

Though the reason thereof is not clear, it is considered that the following reasons are possible.

The endless belt is obtained by kneading the thermoplastic resin and the conductive material and molding an obtained thermoplastic resin composition. At the time of the kneading and forming, the thermoplastic resin composition is melted, and is cooled thereafter.

Here, at the time of the cooling, the cooling speed of the front surface portion or the rear surface portion of the endless belt is different from the cooling speed of the central portion. Specifically, the cooling speed of the front surface portion or the rear surface portion is faster than that of the central portion. Therefore, the front surface portion or the rear surface portion is cooled and solidified in a state in which the conductive material is sufficiently dispersed in the thermoplastic resin, but at this point, the thermoplastic resin composition in the central portion is still in a molten state, and thus the conductive material is movable in the thermoplastic resin. Then, it is considered that the conductive material aggregates with each other. As a result, a specific structure in which the conductive material aggregates in the central portion, and an island part is formed is obtained. In the specific structure, while the volume resistivity of the endless belt is in a certain high state level, the dispersibility of the conductive material in the front surface portion and the rear surface portion may be caused to be higher than that of the central portion. Therefore, it is considered that the decrease of the resistivity in the endless belt according to the exemplary embodiment is prevented, even if the overall volume resistivity is high.

Also, if the endless belt according to the exemplary embodiment is applied to an endless belt for an image forming apparatus, it is possible to obtain an image forming apparatus in which an image defect such as a fine white spot caused by repetitive use, the change of electric resistance of the endless belt accompanying the change of the applied voltage or environmental variation is prevented.

Hereinafter, configuration materials or characteristics of the endless belt according to the exemplary embodiment are described.

The endless belt according to the exemplary embodiment is configured to contain a thermoplastic resin, a conductive material, and, if necessary, other additives.

The thermoplastic resin is described.

Examples of the thermoplastic resin include a polyester resin (for example, a polybutylene terephthalate resin and a polyethylene naphthalate resin), a polyamide resin, a polycarbonate resin, a polysulfone resin, a polyether sulfone resin, a polyphenylene sulfide resin, a polyimide resin, a polyamideimide resin, or a polyetherimide resin.

Among them, as the thermoplastic resin, for example, a polyamide resin, a polyetherimide resin, and a polyphenylene sulfide resin are preferable, and a polyamide resin is more preferable. If these resins are applied as the thermoplastic resin, the mechanical strength of the endless belt increases, and the deformation such as elongation or shrinkage is easily suppressed. As a result, if the endless belt is applied as the intermediate transfer member, the generation of the color shift is easy suppressed. In addition, the thermoplastic resins may be used singly, or two or more types thereof may be used in combination.

The polyamide resin is described.

Examples of the polyamide resin include an aromatic polyamide resin, an aliphatic polyamide resin, and the like. Among them, in view of heat resistance and melt fluidity, the aromatic polyamide resin is preferable, and the semi-aromatic polyamide resin is more preferable.

The semi-aromatic polyamide resin is described.

The semi-aromatic polyamide resin is a semi-aromatic polyamide resin that at least includes a repeating unit structure derived from an aromatic dicarboxylic acid compound and an aliphatic diamine compound. Specifically, examples of the semi-aromatic polyamide resin include a polycondensate of the aromatic dicarboxylic acid compound and the aliphatic diamine compound.

An aromatic dicarboxylic acid compound is a dicarboxylic acid compound including an aromatic ring (for example, a benzene ring, a naphthalene ring, and a biphenyl ring). Specific examples of the aromatic dicarboxylic acid compound include a terephthalic acid, an isophthalic acid, 2,6-naphthalene dicarboxylate, 2,7-naphthalene dicarboxylate, 1,4-naphthalene dicarboxylate, 1,4-phenylene dioxydiacetate, 1,3-phenylene dioxydiacetate, dibenzoic acid, 4,4'-oxydibenzoate, diphenylmethane-4,4-dicarboxylate, diphenyl sulfone-4,4-dicarboxylate, and 4,4'-biphenylcarboxylate. Among these, for example, in view of economic efficiency and performance of polyamide, terephthalic acid, isophthalic acid, and 2,6-naphthalene dicarboxylate are preferable, and terephthalic acid is more preferable.

Examples of the aliphatic diamine include 9 to 12 aliphatic diamines, and specific examples include straight chain aliphatic alkylene diamine (for example, 1,9-nonanediamine, 1,10-decanediamine, 1,11-undecanediamine, and 1,12-dodecanediamine), branched chain aliphatic alkylene diamine (for example, 2,2,4-trimethyl-1,6-hexanediamine, 2,4,4-trimethyl-1,6-hexanediamine, 2,4-diethyl-1,6-hexanediamine, 2,2-dimethyl-1,7-heptanediamine, 2,3-dimethyl-1,7-heptanediamine, 2,4-dimethyl-1,7-heptanediamine, 2,5-dimethyl-1,7-heptanediamine, 2-methyl-1,8-octanediamine, 3-methyl-1,8-octanediamine, 4-methyl-1,8-octanediamine, 1,3-dimethyl-1,8-octanediamine, 1,4-dimethyl-1,8-octanediamine, 2,4-dimethyl-1,8-octanediamine, 3,4-dimethyl-1,8-octanediamine, 4,5-dimethyl-1,8-octanediamine, 2,2-dimethyl-1,8-octanediamine, 3,3-dimethyl-1,8-octanediamine, 4,4-dimethyl-1,8-octanediamine, and 5-methyl-1,9-nonanediamine), and cycloaliphatic alkylene diamine (for example, 1-amino-3-aminomethyl-3,5,5-trimethyl cyclohexane, and 1-amino-3-aminomethyl-2,5,6-trimethyl cyclohexane).

Among these, for example, in view of performance of polyamide or environmental protection, 1,10-decanediamine (decamethylene diamine) and 1,11-undecanediamine are preferable, and 1,10-decanediamine (decamethylene diamine) is more preferable.

Examples of the semi-aromatic polyamide resin include polycondensate of an aromatic dicarboxylic acid compound and an aliphatic diamine compound, but the semi-aromatic polyamide resin may be obtained by polymerizing another monomer with the polycondensate (for example, a polyamide-polyether block copolymer) without deteriorating the function thereof.

Here, in the polyamide-polyether block copolymer, examples of polyether constituting a polyether chain include polyalkyleneglycol containing alkylene having 2 to 6 carbon atoms (preferably 2 to 4 carbon atoms), and specific examples thereof include polytetramethylene glycol (polytetramethylene ether glycol), polyethylene glycol, polypropylene glycol, and copolymers thereof (for example, polyethylene oxide-polypropylene oxide block copolymer).

For example, a commercial product of the semi-aromatic polyamide resin is F2001 manufactured by Daicel-Evonik Ltd.

The polyetherimide resin is described.

For example, the polyetherimide resin may be obtained by polymerization reaction between a dicarboxylic acid dianhydride containing an ether linkage and a diamine. That is, examples of the polyetherimide resin include a polyetherimide resin at least having a repeating unit structure derived from a dicarboxylic acid dianhydride containing an ether linkage and a diamine.

Examples of the dicarboxylic acid dianhydride having an ether linkage include 2,2-bis[4-(3,4-dicarboxyphenoxy)phenyl]propane dianhydride, 4,4'-bis(3,4-dicarboxyphenoxy) diphenyl ether dianhydride, 4,4'-bis(3,4-dicarboxyphenoxy) diphenylsulfide dianhydride, 4,4'-bis(3,4-dicarboxyphenoxy)benzophenone dianhydride, 4,4'-bis(3,4-dicarboxyphenoxy)diphenylsulfone dianhydride, 2,2-bis[4-(2,3-dicarboxyphenoxy)phenyl]propane dianhydride, 4,4'-bis(2,3-dicarboxyphenoxy)diphenyl ether dianhydride, 4,4'-bis(2,3-dicarboxyphenoxy)diphenylsulfide dianhydride, 4,4'-bis(2,3-dicarboxyphenoxy)benzophenone dianhydride, 4,4'-bis(2,3-dicarboxyphenoxy)diphenylsulfone dianhydride, 4-(2,3-dicarboxyphenoxy)-4'-(3,4-dicarboxyphenoxy)diphenyl-2,2-propane dianhydride, 4-(2,3-dicarboxyphenoxy)-4'-(3,4-dicarboxyphenoxy)diphenyl ether dianhydride, 4-(2,3-dicarboxyphenoxy)-4'-(3,4-dicarboxyphenoxy)diphenyl sulfide dianhydride, 4-(2,3-dicarboxyphenoxy)-4'-(3,4-dicarboxyphenoxy)benzophe none dianhydride, and 4-(2,3-dicarboxyphenoxy)-4'-(3,4-dicarboxyphenoxy)diphenyl sulfone dianhydride. The dicarboxylic acid dianhydride may be used singly, or two or more types thereof may be used in combination.

Examples of the diamine include aliphatic diamine, alicyclic diamine, aromatic diamine, and aromatic diamine containing a heterocyclic ring.

Diamine is not particularly limited, as long as it is a diamine compound having two amino groups in a molecular structure.

Examples of the diamine include aromatic diamine such as p-phenylenediamine, m-phenylenediamine, 4,4'-diaminodiphenylmethane, 4,4'-diaminodiphenylethane, 4,4'-diaminodiphenylether, 4,4'-diaminodiphenylsulfide, 4,4'-diaminodiphenylsulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenylether, 2,7-diaminofluorene, 2,2-bis(4-aminophenyl) hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenyleneisopropylidene) bisaniline, 4,4'-(m-phenyleneisopropylidene)bisaniline, 2,2'-bis[4-(4-amino-2-trifluoromethylphenoxy)phenyl] hexafluoropropane, and 4,4'-bis[4-(4-amino-2-trifluoromethyl)phenoxy]-octafluorobiphenyl; aromatic diamine having two amino groups bonded to an aromatic ring such as diaminotetraphenylthiophene and a hetero atom other than a nitrogen atom of the amino groups; and aliphatic diamine or alicyclic diamine such as 1,1-metaxylilenediamine, 1,3-propanediamine, tetramethylenediamine, pentamethylenediamine, octamethylenediamine, nonamethylenediamine, 4,4-diaminoheptamethylenediamine, 1,4-diaminocyclohexane, isophorone diamine, tetrahydrodicyclopentadienylenediamine, hexahydro-4,7-methanoindanylenedimethylenediamine, tricyclo[6,2,1,$0^{2,7}$]-undecylenedimethylenediamine, and 4,4'-methylenebis(cyclohexylamine). The diamine may be used singly or two or more types thereof may be used in combination.

For example, commercial products of the polyetherimide resin are ULTEM 1000 series and 5000 series, and EXTEM VH1003 manufactured by Saudi Basic Industries Corporation (SABIC).

The polyphenylene sulfide resin is described.

For example, the polyphenylene sulfide resin is a resin having a straight chain structure in which benzene rings and sulfur atoms are alternately bonded. Generally, for example, the polyphenylene sulfide resin is a resin that may be obtained by a method of polycondensating p-dichlorobenzene and sodium sulfide at a high temperature of 200° C. to 290° C. under a high pressure in an amide polar solvent (mainly, NMP).

For example, commercial products of the polyphenylene sulfide resin are TORELINA T1881 (manufactured by Toray Industries, Inc.) and FORTRON 0220C9 (manufactured by Polyplastics Co., Ltd.).

As the thermoplastic resin, any one of crystalline thermoplastic resins and amorphous thermoplastic resins may be used singly, or two or more types thereof may be used in combination.

In addition, the term "crystalline" means stepwisely changing endothermic quantity in differential scanning calorimetry (DSC), and having a clear endothermic peak. Specifically, it means that the half value width of the endothermic peak when the measurement is performed at a temperature rising rate of 10 (° C./min) is within 10° C. Accordingly, the thermoplastic resin having the half value width within 10° C. or the thermoplastic resin in which the endothermic peak is clearly acknowledged means the crystalline thermoplastic resin.

Meanwhile, the term "amorphous" means not stepwisely changing endothermic quantity in differential scanning calorimetry (DSC), and not having a clear endothermic peak. Specifically, it means that the half value width of the endothermic peak when the measurement is performed at a temperature rising rate of 10 (° C./min) exceeds 10° C. Accordingly, the thermoplastic resin in which the half value width exceeds 10° C., or the thermoplastic resin in which the endothermic peak is not clearly acknowledged means the amorphous thermoplastic resin.

Here, the amorphous thermoplastic resin and the crystalline thermoplastic resin may be used in combination. In this case, it is preferable to use the polyetherimide resin and the polyamide resin in combination. This is because the mutual compatibility is good.

In addition, it is considered that the compatibility between the polyetherimide resin and the polyamide resin is good, since the intermolecular attraction between the imide bond and the amide bond respectively included in the polyetherimide resin and the polyamide resin easily works, and the interface defect (phase separation) is not likely to occur when both are mixed, the glass transition temperatures thereof are respectively from 270° C. to 350° C., and from 300° C. to 400° C. so that the temperature ranges thereof are overlapped, and both melt at the process temperature (300° C. or higher). Therefore, the specific resin layer has a good film characteristic.

The crystallization degree of the resin obtained by combining, mixing, and melting the amorphous thermoplastic resin and the crystalline thermoplastic resin may be, for example, 30% or greater, preferably 35% or greater, and more preferably 40% or greater.

If the crystallization degree is 30% or greater, there is a tendency that aggregation of the conductive material in the central portion is easily formed. In addition, it is considered that as the crystallization degree is lower, the formation of the aggregate of the conductive material is prevented.

The crystallization degree is determined by the X-ray diffraction measurement. Specifically, the measurement is performed by using an X-ray diffractometer manufactured by Rigaku Corporation, and peak separation analysis in the obtained data is performed by using analysis software manufactured by Bruker Corporation, and the crystallization degree may be calculated from the crystalline peak area and the amorphous peak area after the peak separation.

The conductive material is described.

Examples of the conductive material include carbon black; metal such as aluminum and nickel; metallic oxide such as yttrium oxide and tin oxide; an ion conductive substance of potassium titanate and potassium chloride; a conductive polymer such as polyaniline, polypyrrole, polysulfone, and polyacetylene. Among them, in view of the conductivity and economic efficiency, carbon black is preferable.

The carbon black is described.

Examples of the carbon black include Ketjen black, oil furnace black, channel black, acetylene black, and carbon black having an oxidized surface (hereinafter, referred to as "surface treated carbon black"). Among them, in view of the electric resistance stability with time, surface treated carbon black is preferable.

For example, the surface treated carbon black may be obtained by applying a carboxyl group, a quinine group, a lactone group, a hydroxyl group, and the like, to the surface thereof.

For example, the blending amount of the conductive material is preferably from 10 parts by weight to 30 parts by weight and more preferably from 12 parts by weight to 25 parts by weight with respect to 100 parts by weight of the thermoplastic resin.

If the content of the conductive material is within the above range, the conductive material on the specific resin layer (endless belt 10) becomes highly dense at the conductive point, discharge energies received on the surface of the specific resin layer (endless belt 10) are easily dispersed, and thus the deterioration is prevented.

If the content of the conductive material is within the above range, the endless belt may easily obtain target conductivity, and the conductive point with high density may be easily formed in the specific resin layer (endless belt 10).

Other additives are described.

Examples of other additives include antioxidant for preventing the thermal deterioration of the specific resin layer, surfactant for enhancing the fluidity, if an aliphatic polyamide resin is used, heat resistant antiaging agent, and well-known additives which are blended to the endless belt of the image forming apparatus.

Next, the characteristic of the endless belt 10 according to the exemplary embodiment is described.

With respect to the endless belt 10 (specific resin layer) according to the exemplary embodiment in a room temperature and normal humidity environment (temperature at 22° C. and humidity at 55 RH %), the surface resistivity measured by applying a voltage of 100 V is preferably from 7 log Ω/square to 13 log Ω/square. Particularly, when the endless belt 10 is applied as an intermediate transfer belt, the surface resistivity is preferably from 8 log Ω/square to 12 log Ω/square, and when the endless belt is applied as a recording medium conveying transfer belt, the surface resistivity is preferably from 9 log Ω/square to 13 log Ω/square.

In addition, the surface resistivity is a measurement value measured by applying 100 V of a voltage in a room temperature and normal humidity environment (temperature at 22° C. and humidity at 55 RH %).

In the endless belt 10 (specific resin layer) according to the exemplary embodiment, a difference between surface resistivity measured by applying 100 V of a voltage in a room temperature and normal humidity environment (temperature at 22° C. and humidity at 55 RH %) and surface resistivity measured by applying 1,000 V of a voltage in a room temperature and normal humidity environment (temperature at 22° C. and humidity at 55 RH %) is preferably 1.0 log Ω/square or less.

In the endless belt 10 (specific resin layer) according to the exemplary embodiment, a difference between surface resistivity measured by applying 100 V of a voltage in a low temperature and low humidity environment (temperature at 10° C. and humidity at 10 RH %) and surface resistivity measured by applying 100 V of a voltage in a high temperature and high humidity environment (temperature at 30° C. and humidity at 85 RH %) is preferably 1.0 log Ω/square or less.

Here, with respect to the surface resistivity, conforming to JIS-K-6911 (1995), a circular electrode (UR Probe for HIRESTA IP manufactured by Mitsubishi Chemical Corporation: Φ16 mm of external diameter of cylindrical electrode and Φ30 mm of internal diameter and Φ40 mm of external diameter of ring-shaped electrode) is used, a measurement object is placed on an insulation plate, an objective voltage is applied under the objective environment, and a current value flowing from the external diameter to the internal diameter after 5 seconds from the application is measured by using a microammeter R8340A manufactured by Advantest Corporation, and thus the surface resistivity is obtained from the surface resistance values obtained from the current value.

Hereinafter, a method of manufacturing the endless belt 10 according to the exemplary embodiment is described.

First, for example, the thermoplastic resin, the conductive material, and, if necessary, other additives in respective objective blending amounts are kneaded and mixed to obtain pellets.

Next, the obtained pellets are extruded into a cylindrical shape by using an extruder and are solidified by cooling to obtain a cylindrical molded article. It is possible to control the area ratio of the front surface portion and the rear surface portion of the sea part to the central portion of the sea part by controlling the temperature at the time of extrusion and the temperature at the time of solidification by cooling.

Also, the obtained cylindrical molded article is cut by an objective width to obtain the endless belt 10.

The aforementioned endless belt 10 according to the exemplary embodiment is described to be configured with a single layer member of a specific resin layer. However, the endless belt 10 may be configured with a laminate of two or more layers, as long as the endless belt 10 has the specific resin layer.

Specifically, for example, the endless belt 10 according to the exemplary embodiment is configured with a laminate of a base material layer and a surface layer (surface releasing layer) on an outer peripheral surface of the base material layer, and the specific resin layer may be applied as at least one of the base material layer and the surface layer. However, if the specific resin layer is applied as the surface layer, a release agent (for example, fluorine compound (fluorine resin, or particles thereof)) may be blended.

An intermediate layer (for example, elastic layer) may be provided between the base material layer and the surface layer, or the base material layer itself may be configured with a laminate of two or more layers.

The endless belt 10 according to the exemplary embodiment is applied, for example, to a belt for an image forming apparatus (for example, intermediate transfer belt, and recording medium conveying transfer belt).

Tubular Member Unit

Figure 2:
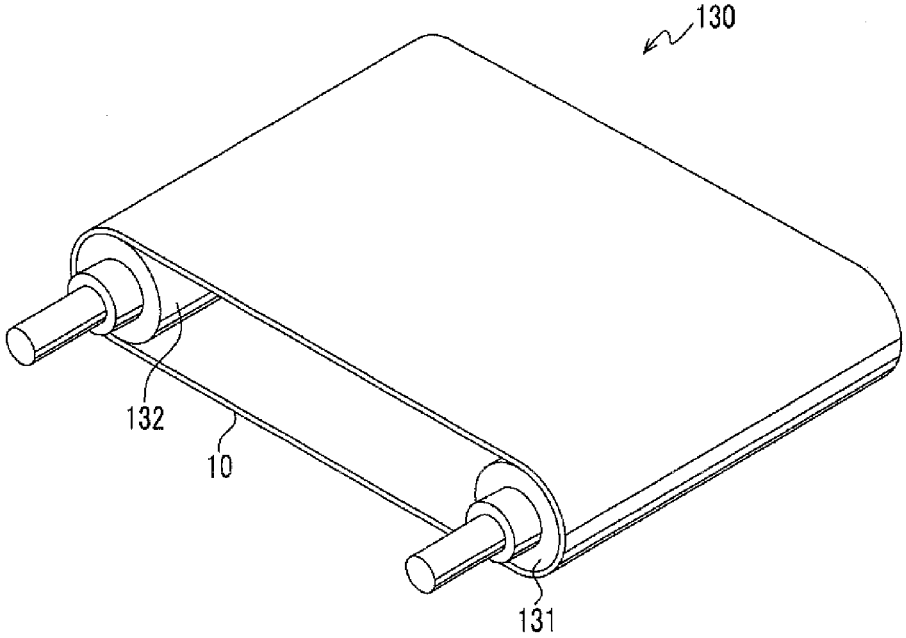
FIG. 2 is a perspective view schematically illustrating a tubular member unit according to the exemplary embodiment.

FIG. 2 is a perspective view schematically illustrating the tubular member unit according to the exemplary embodiment.

As illustrated in FIG. 2, a tubular member unit 130 according to the exemplary embodiment (hereinafter, referred to as an "endless belt unit") includes the endless belt 10 according to the exemplary embodiment. For example, the endless belt 10 is suspended (hereinafter, also referred to as "stretches") with a tension applied by a driving roll 131 and a driven roll 132 which are positioned to face each other.

Here, if the endless belt 10 is applied as an intermediate transfer member, as rolls for stretching the endless belt 10, the endless belt unit 130 according to the exemplary embodiment includes a roll for primarily transferring a toner image on a surface of a photoreceptor (image holding member) to the endless belt 10, and a roll for secondarily transferring the toner image transferred to the endless belt 10 to a recording medium.

In addition, the number of rolls that stretch the endless belt 10 is not limited, and the rolls may be arranged according to the usage pattern. The endless belt unit 130 according to the exemplary embodiment is incorporated into an apparatus to be used, and the endless belt 10 rotates in a state of being stretched, in response to the rotation of the driving roll 131 and the driven roll 132.

Image Forming Apparatus

The image forming apparatus according to the exemplary embodiment includes an image holding member, a charging unit that charges a surface of the image holding member, a latent image forming unit that forms a latent image on the surface of the image holding member, a development unit that develops the latent image with toner to form a toner image, a transfer unit that transfers the toner image on a recording medium, and a fixing unit that fixes the toner image on the recording medium, and the transfer unit includes an endless belt according to the exemplary embodiment.

Specifically, in the image forming apparatus according to the exemplary embodiment, for example, the transfer unit includes an intermediate transfer member, a primary transfer unit that primarily transfers a toner image formed on the image holding member to the intermediate transfer member, and a secondary transfer unit that secondarily transfers the toner image transferred to the intermediate transfer member to the recording medium, and includes the endless belt according to the exemplary embodiment as the intermediate transfer member.

In addition, the image forming apparatus according to the exemplary embodiment includes, for example, a conveying transfer member (conveying transfer belt) that causes a sheet transfer member to convey the recording medium, and the transfer unit that transfers the toner image formed on the image holding member to the recording medium transferred by the sheet transfer member, and includes the endless belt according to the exemplary embodiment as a recording medium transfer member.

Examples of the image forming apparatus according to the exemplary embodiment include a well-known monocolor image forming apparatus that only contains a monochrome toner in a developing device, a color image forming apparatus that sequentially repeats primary transfer of a toner image held in an image holding member to an intermediate transfer member, and a tandem-type color image forming apparatus that arranges plural image holding members including developer units for various colors on the intermediate transfer member in series.

Hereinafter, the image forming apparatus according to the exemplary embodiment is described with reference to the drawings.

Figure 3:
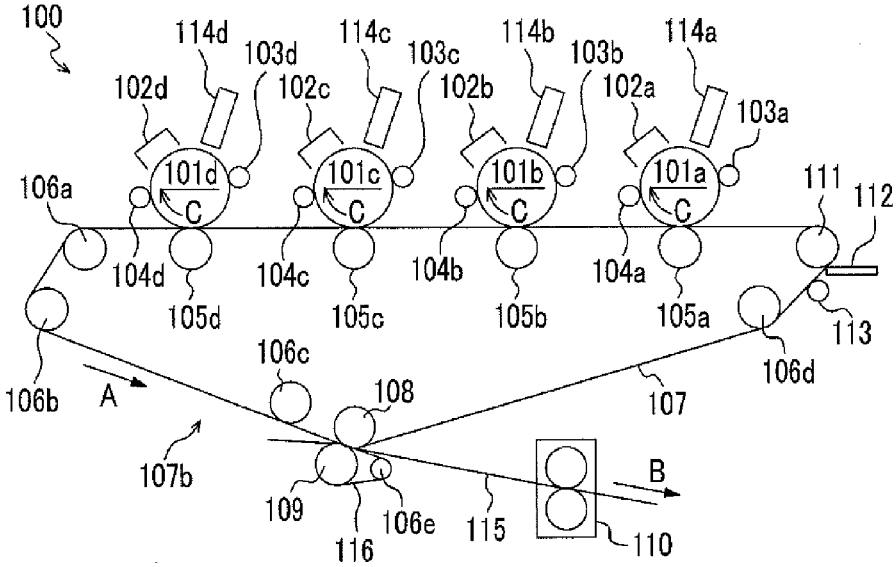
FIG. 3 is a diagram schematically illustrating a configuration of an image forming apparatus according to the exemplary embodiment.

FIG. 3 is a diagram schematically illustrating a configuration of an image forming apparatus according to the exemplary embodiment.

As illustrated in FIG. 3, an image forming apparatus 100 according to the exemplary embodiment is a so-called tandem type, and charging devices 102*a* to 102*d*, exposure devices 114*a* to 114*d*, developing devices 103*a* and 103*d*, primary transfer devices (primary transfer rolls) 105*a* to 105*d*, and image holding member cleaning devices 104*a* to 104*d* are arranged around four image holding members 101*a* to 101*d* formed of electrophotographic photoreceptors sequentially along the rotation direction thereof. Further, in order to remove residual potentials remaining on the surfaces of the image holding members 101*a* to 101*d* after transfer, an erasing device may be included.

While receiving tension, an intermediate transfer belt 107 is supported by supporting rolls 106*a* to 106*d*, a driving roll 111, and a counter roll 108 to form a tubular member unit 107*b*. By these supporting rolls 106*a* to 106*d*, the driving roll 111, and the counter roll 108, the intermediate transfer belt 107 may cause the image holding members 101*a* to 101*d* and the primary transfer rolls 105*a* to 105*d* to move in the arrow A direction while contacting the surfaces of the image holding members 101*a* to 101*d*. Portions in which the primary transfer rolls 105*a* to 105*d* contact the image holding members 101*a* to 101*d* via the intermediate transfer belt 107 become primary transfer portions, and the primary transfer voltage is applied to contact portions between the image holding members 101*a* to 101*d* and the primary transfer rolls 105*a* to 105*d*.

As a secondary transfer device, the counter roll 108 and a secondary transfer roll 109 are arranged to face each other via the intermediate transfer belt 107 and a secondary transfer belt 116. A recording medium 115 such as paper moves in an arrow B direction in an area interposed between the intermediate transfer belt 107 and the secondary transfer roll 109 while contacting the surface of the intermediate transfer belt 107, and then passes through a fixing device 110. A portion in which the secondary transfer roll 109 contacts the counter roll 108 via the intermediate transfer belt 107 and the secondary transfer belt 116 becomes a secondary transfer portion, and thus a secondary transfer voltage is applied to a contact portion between the secondary transfer roll 109 and the counter roll 108. Further, intermediate transfer belt cleaning devices 112 and 113 are arranged so as to contact the intermediate transfer belt 107 after transfer.

In the multiple color image forming apparatus 100 having the configuration described above, an image holding member 101*a* rotates in an arrow C direction, the surface thereof is charged by a charging device 102*a*, and then an electrostatic latent image for a first color is formed by the exposure device 114*a* of laser light or the like. By the developing device 103*a* accommodating toner corresponding to the color, the formed electrostatic latent image is developed (visualized) with toner to form a toner image. In addition, toner (for example, yellow, magenta, cyan, and black) corresponding to electrostatic latent images for the respective colors is accommodated in the developing devices 103*a* and 103*d*.

When the toner image formed on the image holding member 101*a* passes through the primary transfer portion, the toner image is electrostatically transferred to the intermediate transfer belt 107 by the primary transfer roll 105*a* (primary transfer). Thereafter, toner images for second, third, and fourth colors are primarily transferred to the intermediate transfer belt 107 that holds the toner image for the first color by the primary transfer rolls 105*b* to 105*d* in a sequentially superimposed manner.

The multiple toner images formed on the intermediate transfer belt 107 are collectively and electrostatically transferred to the recording medium 115 when passing through the secondary transfer portion. The recording medium 115 to which the toner images transferred is conveyed to the fixing device 110, is subjected to a fixing process by at least one of heating and pressing, and is discharged to the outside of the apparatus.

In the image holding members 101*a* to 101*d* after the primary transfer, residual toner is removed by the image holding member cleaning devices 104*a* to 104*d*. Meanwhile, in the intermediate transfer belt 107 after the secondary transfer, residual toner is removed by the intermediate transfer belt cleaning devices 112 and 113, and the intermediate transfer belt 107 prepares for the next image forming process.

Image Holding Member

A well-known electrophotographic photoreceptor is widely used as the image holding members 101*a* to 101*d*. As the electrophotographic photoreceptor, an inorganic photoreceptor in which the photosensitive layer is configured with an inorganic material, or an organic photoreceptor in which the photosensitive layer is configured with an organic material is used. With respect to the organic photoreceptor, a function separation-type organic photoreceptor obtained by stacking a charge generating layer that generates electric charges by exposure and an electric charge transporting layer that transports the electric charges, or a single layer-type organic photoreceptor that accomplishes a function of generating electric charges and a function of transporting electric charges is preferably used. Also, with respect to the inorganic photoreceptor, a photoreceptor in which a photosensitive layer is configured with amorphous silicon is appropriately used.

In addition, the formation of the image holding member is not particularly limited. For example, well-known shapes such as a cylindrical drum shape, a sheet shape, and a plate shape are employed.

Charging Device

The charging devices 102*a* to 102*d* are not particularly limited. For example, well-known chargers such as contact type chargers using conductive (here, the term "conductive" in a charging device means that, for example, volume resistivity is less than $10^7$ Ω·cm) or semiconductive (here, the "semiconductive" in a charging device means that, for example, volume resistivity is $10^7$ to $10^{13}$ Ωcm) rolls, brushes, films, or rubber blades, scorotron chargers that use corona discharges, or corotron chargers are widely applied. Among these, the contact-type charger is preferable.

The charging devices 102*a* to 102*d* generally apply direct currents to the image holding members 101*a* to 101*d*, but may further apply alternate currents in an superimposed manner.

Exposure Device

The exposure devices 114*a* to 114*d* are not particularly limited. However, for example, as the exposure devices 114*a* to 114*d*, well-known exposure devices such as an optical device that may expose according to an image data on the surfaces of the image holding members 101*a* to 101*d* with light from a light source such as semiconductor laser light, light emitting diode (LED) light, or liquid crystal shutter or with light transmitted from the light sources via a polygon mirror are widely applied.

Developing Device

The developing devices 103*a* and 103*d* are selected according to the purpose. For example, a well-known developing device that develops a single component developer or a two component developer by using a brush, a roll, or the like on a contact or contactless manner may be used.

Primary Transfer Roll

The primary transfer rolls 105*a* to 105*d* may have a single layer structure or a multiple layer structure. For example, in the case of the single layer structure, the primary transfer rolls 105*a* to 105*d* are configured with rolls in which proper quantities of conductive particles such as carbon black are blended with foamed or non-foamed silicone rubber, urethane rubber, or EPDM.

Image Holding Member Cleaning Device

The image holding member cleaning devices 104*a* to 104*d* are provided to remove residual toner attached to the surfaces of the image holding members 101*a* to 101*d* after the primary transfer process, brush cleaning or roll cleaning may be performed instead of using other than cleaning blade. Among these, a cleaning blade is preferably used. In addition, as a material of the cleaning blade, urethane rubber, neoprene rubber, or silicone rubber may be used.

Secondary Transfer Roll

A layer structure of the secondary transfer roll 109 is not particularly limited. For example, in the case of the three layer structure, the secondary transfer roll 109 is configured with a core layer, an intermediate layer, and a coating layer that covers a front surface thereof. A core layer is configured with a foaming member of silicone rubber, urethane rubber, EPDM or the like in which conductive particles are dispersed, and an intermediate layer is configured with a non-foaming member thereof. As a material of the coating layer, a tetrafluoroethylene-hexafluoropropylene copolymer, or a perfluoroalkoxy resin may be used. The volume resistivity of the secondary transfer roll 109 is preferably $10^7$ Ωcm or less. In addition, the secondary transfer roll 109 may have a two layer structure except for the intermediate layer.

Counter Roll

The counter roll 108 forms a counter electrode of the secondary transfer roll 109. The layer structure of the counter roll 108 may be a single layer structure or a multiple layer structure. For example, in the case of the single layer structure, the counter roll 108 is configured with a roll in which proper quantities of conductive particles such as carbon black are blended with silicone rubber, urethane rubber, or EPDM. In the case of the two layer structure, the counter roll 108 is configured with a roll obtained by covering an outer peripheral surface of an elastic layer configured with the rubber materials described above with a high resistance layer.

A voltage of 1 kV to 6 kV is generally applied to shafts of the counter roll 108 and the secondary transfer roll 109. Instead of the application of the voltage to the shaft of the counter roll 108, a voltage may be applied to an electrode member with excellent electric conductivity that comes into contact with the counter roll 108 and the secondary transfer roll 109. As the electrode member, a metal roll, a conductive rubber roll, a conductive brush, a metal plate, or a conductive resin plate, or the like may be used.

Fixing Device

For example, as the fixing device 110, well-known fusers such as a heating roll fixing device, a pressure roll fixing device, and a flush fixing device are widely applied.

Intermediate Transfer Belt Cleaning Device

As the intermediate transfer belt cleaning devices 112 and 113, in addition to the cleaning blade, brush cleaning, roll cleaning, and the like may be used, and among them, the cleaning blade is preferably used. In addition, as the material of the cleaning blade, urethane rubber, neoprene rubber, silicone rubber, or the like may be used.

EXAMPLE

Hereinafter, the invention is described in detail with reference to examples. However, the invention is not limited thereto.

Example 1

Preparation of Resin Pellets

As the crystalline thermoplastic resin, 100 parts by weight of a semi-aromatic polyamide resin (F2001 manufactured by Daicel-Evonik Ltd.) is melted in a twin screw extruding melting kneader (twin screw melting kneading extruder L/D60 manufactured by Parker corporation, Inc.), 8 parts by weight of carbon black (Monark 880 manufactured by Cabot Corporation) is supplied as the conductive material in the molten resin by using a side feeder from a side of the kneader, the resultant is molten-kneaded, the molten-kneaded material is input to a water tank, and solidified by cooling, and the solidified material is cut by an objective size to obtain mixed resin pellets in which carbon black is blended.

Manufacturing Endless Belt

The obtained mixed resin pellets are inserted to a single screw melting extruder (L/D24, melting extruding apparatus manufactured by Mitsuba MFG. Co., Ltd.) (310° C. of heating temperature), is melted and extruded from a gap between a mold die set to 300° C. and a nipple, and is cooled down by causing an outer surface of the cylindrical inner sizing die (30° C. of temperature) to bring into contact with an inner peripheral surface of the molten resin, to obtain an endless belt of Example 1 having ϕ160 mm of an external diameter, 232 mm of a width, and 120 μm of an average thickness.

Examples 2 to 14 and Comparative Examples 1 and 2

Endless belts of Examples 2 to 14 and Comparative Examples 1 and 2 are manufactured in the same manner as in Example 1 except that materials presented in Table 1 are used.

Example 15

An endless belt of Example 15 is manufactured in the same manner as in Example 7 except that a heating temperature of the single screw melting extruder is 340° C., and a temperature of a mold die is 330° C.

Example 16

An endless belt of Example 16 is manufactured in the same manner as in Example 7 except that a heating temperature of the single screw melting extruder is 290° C., and a temperature of a mold die is 280° C.

Measuring Area Ratio of Sea Part

With respect to endless belts obtained in the respective examples, each area ratio of sea parts (thermoplastic resin parts) in a range of 10 μm respectively from a front surface portion and a rear surface portion in a thickness direction and in a range of ±5 μm with a central portion in a thickness direction as a center is measured in a sequence below, and is presented in Table 1.

First, the endless belts are cut in an axial direction with a cutter knife or the like in a rectangular strip shape of about 1 mm×8 mm, and then are embedded with an epoxy resin. After solidification, cross-section samples are manufactured with a microtome provided with a diamond knife. For example, as the microtome, ultramicrotome UCT manufactured by Leica Microsystems Ltd. may be used.

Specifically, in positions of 5 mm from one end and the other end of the endless belt in the axial direction, and a position of the central portion of the endless belt in the axial direction, with respect to 4 portions for each 90° in a circumferential direction (4×3=12 portions in total), the cross-section samples are manufactured.

The front surface portions, the rear surface portions, and the central portions of the respective obtained cross-section samples are observed in the magnification of 5000 times by using JSM-6700F manufactured by JEOL, Ltd.

Subsequently, an area ratio of the thermoplastic resin of which a sea part is 10 μm in vertical and is a visual width in horizontal is calculated with image processing software, and an average value of all samples is calculated. In addition, when contrast is unclear, a contrast intensifying process or a smoothing process is appropriately performed. As the image processing software, for example, freeware such as ImageJ may be used.

If there is unevenness in the front surface portion and the rear surface portion in an observation visual field, the measurement target is to the height of the lowest concave portion in the cross section. That is, portions higher than the lowest concave portion are out of the measurement target. In addition, when there is no unevenness in the front surface portion and the rear surface portion in the observation visual field, all areas from the front surface portion and the rear surface portion to 10 μm may be the measurement target.

In addition, when there is unevenness in the front surface portion and the rear surface portion in the observation visual field, the measurement of the central portion is performed such that a range of 5 μm from the center of the lowest concave portion in the cross sections of the front surface portion and the rear surface portion which are measurement targets as described above respectively to the front surface portion and the rear surface portion side becomes a measurement target. In addition, when there is no unevenness in the front surface portion and the rear surface portion in the observation visual field, a range of 5 μm from the center between the front surface portion and the rear surface portion respectively to the front surface portion and the rear surface portion side may be a measurement target.

Estimation

Electric Resistance Stability

With respect to the endless belts obtained in respective examples, before an actual machine test (before test run) and after the test (after test run), surface resistivity (log Ω/square) is measured in an environment of a temperature at 22° C. and humidity of 55 RH %, by using Advantest microammeter (UR probe/100 V/2 kg of load/10 seconds), and the electric resistance stability is estimated with criteria below. Obtained estimation results are described in Table 1.

Actual Machine Test

The endless belts obtained in the respective examples are mounted on an image forming apparatus "C2250 manufactured by Fuji Xerox Co., Ltd." as intermediate transfer belts, 50,000 sheets of images are continuously printed in a low temperature and low humidity environment (10° C./10 RH %)

(environment in which electric discharge easily occurs accompanied by paper peeling on surface of intermediate transfer belt at the time of transfer).

Criteria

A: Difference of surface resistivity before and after actual machine test is less than 0.2 (log Ω/square)

B: Difference of surface resistivity before and after actual machine test is 0.2 (log Ω/square) or greater and less than 0.5 (log Ω/square)

C: Difference of surface resistivity before and after actual machine test is 0.5 (log Ω/square) or greater and less than 1.0 (log Ω/square)

D: Difference of surface resistivity before and after actual machine test is 1.0 (log l/square) or greater In addition, details of the abbreviations in Table 1 are as follows.

F2001: Polyamide resin F2001 (manufactured by Daicel-Evonik Ltd.) ULTEM10101V: Polyetherimide resin ULTEM 10101V (manufactured by Saudi Basic Industries Corporation)

T1881: Polyphenylene sulfide resin T1881 (manufactured by Toray Industries, Inc.)

Monark880: Carbon black Monark 880 (manufactured by Cabot Corporation)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

TABLE 1

| | Thermoplastic resin | | Conductive material | | | | | Difference between a greater | Evaluation |
|---|---|---|---|---|---|---|---|---|---|
| | | Weight | | Weight | Area ratio of sea part | | | one of front surface portion | Electric |
| | Resin | [Parts by weight] | Conductive material | [Parts by weight] | Front surface portion [%] | Rear surface portion [%] | Central portion [%] | and rear surface portion and central portion | resistance stability |
| Example 1 | F2001 | 100 | Monak880 | 8 | 15.5 | 15.4 | 25.7 | 10.2 | C |
| Example 2 | F2001 | 100 | Monak880 | 10 | 14 | 14.1 | 21.5 | 7.4 | B |
| Example 3 | F2001 | 100 | Monak880 | 11 | 13.9 | 13.3 | 21.3 | 7.4 | B |
| Example 4 | F2001 | 100 | Monak880 | 12 | 13.8 | 13.1 | 19.3 | 5.5 | A |
| Example 5 | F2001 | 100 | Monak880 | 13 | 13.7 | 13.2 | 19.2 | 5.5 | A |
| Example 6 | F2001 | 100 | Monak880 | 14 | 13.8 | 13 | 19.2 | 5.4 | A |
| Example 7 | F2001 | 100 | Monak880 | 15 | 13.6 | 13.4 | 18.8 | 5.2 | A |
| Example 8 | F2001 | 100 | Monak880 | 20 | 13 | 12.5 | 18.2 | 5.2 | A |
| Example 9 | F2001 | 100 | Monak880 | 25 | 12.4 | 12.6 | 17.7 | 5.1 | A |
| Example 10 | F2001 | 100 | Monak880 | 27 | 12 | 12.3 | 16.4 | 4.1 | B |
| Example 11 | F2001 | 100 | Monak880 | 30 | 12.1 | 12.2 | 16.2 | 4 | B |
| Example 12 | F2001 | 100 | Monak880 | 32 | 12 | 12 | 15.1 | 3.1 | C |
| Example 13 | ULTEM 10101V | 100 | Monak880 | 15 | 13.4 | 13.3 | 18.6 | 5.2 | A |
| Example 14 | T1881 | 100 | Monak880 | 15 | 13.7 | 13.5 | 19.5 | 5.8 | A |
| Example 15 | F2001 | 100 | Monak880 | 15 | 15.9 | 15.8 | 26 | 10.1 | C |
| Example 16 | F2001 | 100 | Monak880 | 15 | 13.6 | 13.5 | 20.4 | 6.8 | B |
| Comparative Example 1 | F2001 | 100 | Monak880 | 5 | 16.5 | 16.9 | 32.8 | 15.9 | D |
| Comparative Example 2 | F2001 | 100 | Monak880 | 35 | 11.8 | 11.6 | 13.6 | 1.8 | D |

From the above results, it is found that the examples have excellent electric resistance stability compared with the comparative examples.

Regarding to the blending amount of the conductive material, Examples 2 to 11 in which the blending amount of the conductive material is 10 parts by weight to 30 parts by weight with respect to 100 parts by weight of the thermoplastic resins have excellent electric resistance stability compared with Examples 1 and 12 in which the blending amount of the conductive material is less than 10 parts by weight or exceeds 30 parts by weight with respect to 100 parts by weight of the thermoplastic resins.

Further, Examples 4 to 9 in which the blending amount of the conductive material is from 12 parts by weight to 25 parts by weight with respect to 100 parts by weight of the thermoplastic resins have excellent electric resistance stability compared with Examples 2, 3, 10, and 11 in which the blending amount of the conductive material is 10 parts by weight or greater and less than 12 parts by weight, or exceeds 25 parts by weight and is 30 parts by weight or less with respect to 100 parts by weight of the thermoplastic resins.

In addition, it is found that with respect to Examples 7, 15, and 16 having the same composition, the area ratios of the sea parts are controlled by the temperature condition at the time of manufacturing.

What is claimed is:

1. A tubular member comprising:

a resin layer containing a thermoplastic resin and a conductive material, and the resin layer comprising:

a sea part in which the thermoplastic resin has a matrix phase, a front surface portion;

a rear surface portion;

a center between the front surface portion and a rear surface portion; and a central portion measured from (A) 5 μm from the center towards the front surface portion in a thickness direction to (B) 5 μm from the center towards the rear surface portion in the thickness direction; and wherein a first area ratio of the sea part between (1) an area of the sea part to (2) an area of the central portion is greater by 3% to 15% than the larger ratio of:

a second area ratio of (1) the area of the sea part to (2) an area of a portion of the resin layer measured as 10 μm of from the front surface portion in the thickness direction, or a third area ratio of (1) the area of the sea part to (2) an area of a portion of the resin layer measured as 10 μm of from the rear surface portion in the thickness direction, and wherein the first, second and third ratios are different from each other.

2. The tubular member according to claim 1, wherein the first area ratio is greater by 4.0% to 10% than the larger of: the second area ratio or third area ratio.

3. The tubular member according to claim 2, wherein the thermoplastic resin is a polyamide resin.

4. The tubular member according to claim 3, wherein a blending amount of the conductive material is from 10 parts by weight to 30 parts by weight with respect to 100 parts by weight of the thermoplastic resin.

5. The tubular member according to claim 3, wherein a blending amount of the conductive material is from 12 parts by weight to 25 parts by weight with respect to 100 parts by weight of the thermoplastic resin.

6. The tubular member according to claim 2, wherein a blending amount of the conductive material is from 10 parts by weight to 30 parts by weight with respect to 100 parts by weight of the thermoplastic resin.

7. An image forming apparatus comprising:

an image holding member;

a charging unit that charges a surface of the image holding member;

a latent image forming unit that forms a latent image on the surface of the image holding member;

a development unit that develops the latent image on the surface of the image holding member with toner to form a toner image;

an intermediate transfer member formed of the tubular member according to claim 6 by which the toner image formed on the surface of the image holding member is transferred;

a primary transfer unit that primarily transfers the toner image formed on the surface of the image holding member to a surface of the intermediate transfer member;

a secondary transfer unit that secondarily transfers the toner image transferred to the surface of the intermediate transfer member to a recording medium; and a fixing unit that fixes the toner image transferred to the recording medium.

8. The tubular member according to claim 2, wherein a blending amount of the conductive material is from 12 parts by weight to 25 parts by weight with respect to 100 parts by weight of the thermoplastic resin.

9. The tubular member according to claim 1, wherein the first area ratio is greater by 5.0% to 6.5% than the larger of: the second area ratio or third area ratio.

10. The tubular member according to claim 9, wherein the thermoplastic resin is a polyamide resin.

11. The tubular member according to claim 10, wherein a blending amount of the conductive material is from 10 parts by weight to 30 parts by weight with respect to 100 parts by weight of the thermoplastic resin.

12. The tubular member according to claim 9, wherein a blending amount of the conductive material is from 10 parts by weight to 30 parts by weight with respect to 100 parts by weight of the thermoplastic resin.

13. The tubular member according to claim 9, wherein a blending amount of the conductive material is from 12 parts by weight to 25 parts by weight with respect to 100 parts by weight of the thermoplastic resin.

14. The tubular member according to claim 1, wherein the thermoplastic resin is a polyamide resin.

15. The tubular member according to claim 14, wherein a blending amount of the conductive material is from 10 parts by weight to 30 parts by weight with respect to 100 parts by weight of the thermoplastic resin.

16. The tubular member according to claim 14, wherein a blending amount of the conductive material is from 12 parts by weight to 25 parts by weight with respect to 100 parts by weight of the thermoplastic resin.

17. The tubular member according to claim 1, wherein a blending amount of the conductive material is from 10 parts by weight to 30 parts by weight with respect to 100 parts by weight of the thermoplastic resin.

18. The tubular member according to claim 1, wherein a blending amount of the conductive material is from 12 parts by weight to 25 parts by weight with respect to 100 parts by weight of the thermoplastic resin.

19. A tubular member unit comprising:

the tubular member according to claim 1; and a plurality of rolls on which the tubular member is suspended with a tension applied thereto, wherein the tubular member is detachable from an image forming apparatus.

20. An intermediate transfer member formed of the tubular member according to claim 1.

* * * * *